United States Patent [19]

Bandukwalla

[11] Patent Number: 4,850,795

[45] Date of Patent: Jul. 25, 1989

[54] DIFFUSER HAVING RIBBED VANES FOLLOWED BY FULL VANES

[75] Inventor: Phiroze Bandukwalla, Olean, N.Y.

[73] Assignee: Dresser-Rand Company, Corning, N.Y.

[21] Appl. No.: 153,593

[22] Filed: Feb. 8, 1988

[51] Int. Cl.[4] ..... F04D 29/46

[52] U.S. Cl. ..... 415/148; 415/208.4

[58] Field of Search ..... 415/148, 149 R, 150, 415/151, 157, 158, 181, 211, DIG. 1

[56] References Cited

U.S. PATENT DOCUMENTS

| | | | |
|---|---|---|---|
| 1,047,663 | 12/1912 | Lawaczeck | 415/211 |
| 2,739,782 | 3/1956 | White | 415/150 |
| 2,846,185 | 8/1958 | Widmer | 415/158 |
| 2,996,996 | 8/1961 | Jassniker | 415/157 |
| 3,069,070 | 12/1962 | Macaluso et al. | 415/211 X |
| 3,079,127 | 2/1963 | Rowlett et al. | 415/158 |
| 3,365,120 | 1/1968 | Jassniker | 415/158 |
| 3,588,270 | 6/1971 | Boelcs | 415/160 |
| 3,781,128 | 12/1973 | Bandukwalla | 415/211 |
| 3,784,318 | 1/1974 | Davis | 415/158 |
| 3,861,826 | 1/1975 | Dean, Jr. | 415/211 |
| 4,008,010 | 2/1977 | Fauconnet | 415/158 X |
| 4,056,330 | 11/1977 | Lieber | 415/158 X |
| 4,070,132 | 1/1978 | Lynch | 415/48 |
| 4,218,182 | 8/1980 | Tsunoda et al. | 415/205 |
| 4,292,807 | 10/1981 | Rannenberg | 415/158 X |
| 4,354,802 | 10/1982 | Nishida et al. | 415/211 X |
| 4,378,194 | 3/1983 | Bandukwalla | 415/49 |
| 4,395,197 | 7/1983 | Yoshinaga et al. | 415/211 |
| 4,403,914 | 9/1983 | Rogo et al. | 415/165 |
| 4,421,457 | 12/1983 | Yoshinaga et al. | 415/211 |
| 4,470,256 | 9/1984 | Palmer | 415/150 X |
| 4,527,949 | 7/1985 | Kirtland | 415/150 |
| 4,544,325 | 10/1985 | Rogo et al. | 415/150 |
| 4,626,168 | 12/1986 | Osborne et al. | 415/211 |

FOREIGN PATENT DOCUMENTS

| | | | |
|---|---|---|---|
| 2135286 | 2/1973 | Fed. Rep. of Germany . | |
| 971224 | 1/1951 | France . | |
| 119411 | 4/1972 | Japan . | |
| 101299 | 1/1976 | Japan . | |
| 53-112907 | 10/1978 | Japan | 415/148 |
| 54-104007 | 8/1979 | Japan | 415/148 |
| 61-38198 | 2/1986 | Japan | 415/211 |
| 522343 | 9/1972 | U.S.S.R. . | |
| 879047 | 11/1981 | U.S.S.R. | 415/211 |
| 1286824 | 1/1987 | U.S.S.R. | 415/211 |
| 696817 | 9/1953 | United Kingdom | 415/148 |

OTHER PUBLICATIONS

Abdelhamid, A. N., "Analysis of Rotating Stall in Vaneless Diffusers of Centrifugal Compressors," The American Society of Mechanical Engineers, Bulletin No. 80-GT-184, Mar. 1980.

Abdelhamid, A. N., "Effects of Vaneless Diffuser Geometry on Flow Instability in Centrifugal Compression Systems," The American Society of Mechanical Engineers, Bulletin No. 81-GT-10, Mar. 1981.

Appendix E from "Advanced Concepts in Turbomachinery," Fluid Dynamics Institute, Aug. 17-21, 1981 Symposium.

*Primary Examiner*—Robert E. Garrett

*Assistant Examiner*—Joseph M. Pitko

[57] ABSTRACT

An improved diffuser is provided for centrifugal compressors and the like. In the improved diffuser, ribbed vanes are aligned with the log spiral core flow within the diffuser and are located radially inwardly of full vanes on a fixed or variable width diffuser.

17 Claims, 1 Drawing Sheet

FIG. 1
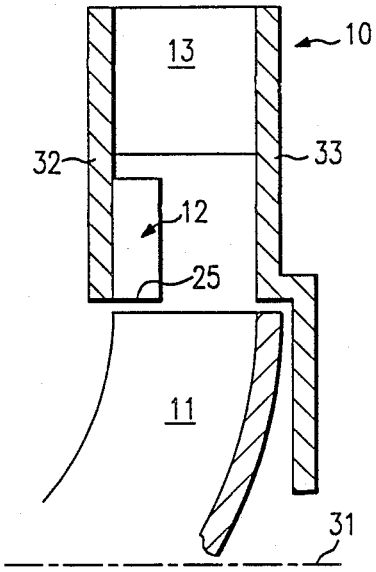
FIG. 2
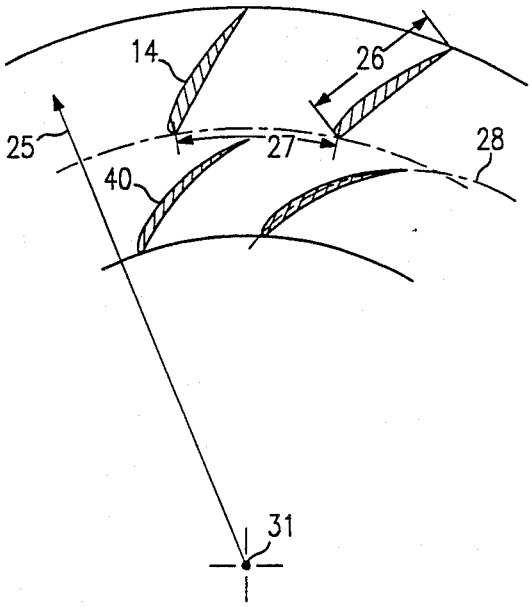
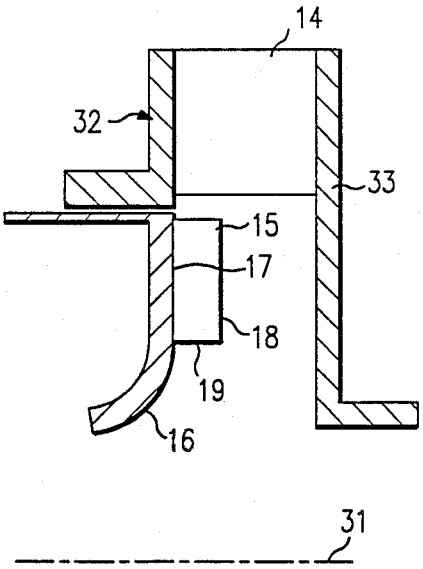
FIG. 3
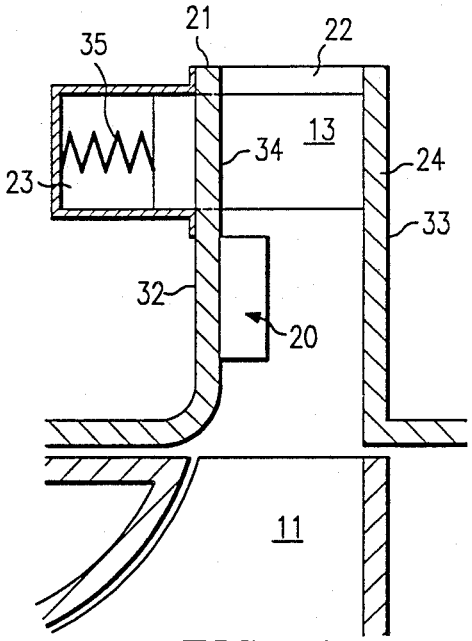
FIG. 4

DIFFUSER HAVING RIBBED VANES FOLLOWED BY FULL VANES

FIELD OF THE INVENTION

The present invention pertains to an improved diffuser structure for a centrifugal compressor, and more particularly to a vaned diffuser having ribbed vanes and an adjustable wall.

BACKGROUND OF THE INVENTION

It has been demonstrated that in a diffuser of a centrifugal compressor, ribbed vanes forming a logarithmic spiral or circular arc have the effect of energizing the boundary layer flow without sacrifice to the core flow. The result is increased range and efficiency to the compressor. Full vanes are known to improve efficiency over vaneless designs, but at the expense of range.

The need for further improvements in range and efficiency led to the developments of the present invention.

SUMMARY OF THE INVENTION

The objects of the present invention, particularly enhanced range and efficiency, are achieved by providing, in a compressor diffuser, ribbed vanes which follow the log spiral core flow, followed in the flow path by full vanes which divert the log spiral flow toward the radial. High solidity full vanes in conjunction with a movable ribbed diffuser section enhance performance further.

BRIEF DESCRIPTION OF THE DRAWINGS

FIG. 1 is a cross section of a diffuser of the present invention, where ribbed vanes are followed by full vanes.

FIG. 2 is a cross section of the present invention where the full vanes are of low solidity.

FIG. 3 is a cross section of the present invention whereby the ribbed vanes are adjustable with respect to full vanes of fixed width.

FIG. 4 is a cross section view of an alternate expression of the present invention. Ribbed vanes are mounted on a movable wall whereby the width of the full vanes is also adjustable.

DESCRIPTION OF THE INVENTION

In FIG. 1, a centrifugal impeller 11 is shown in proximity to the improved diffuser 10 of the present invention. The diffuser is characterized by a central axis 31 (co-linear to the axis of rotation of the impeller), a first wall or shroud-side wall 32 and a second wall or hub-side wall 33. Near the entry to the diffuser, an array of ribbed vanes 12 is oriented in alignment with the log spiral core flow from the impeller. For the present purposes a ribbed vane is considered a vane which does not completely span the width of the diffuser, whereas a full vane does. The ribbed vanes are affixed to the first wall 32. It is contemplated that low spiral or circular arc vanes can be used. Low spiral vanes are more effective, but circular arc vanes are cheaper to manufacture. Flow which passes over the ribbed vanes is energized and directed with the core flow towards an array of full vane islands or high efficiency wedged vanes 13. Thus the full vanes are said to "follow" the ribbed vanes. The arrangement shown in FIG. 1 eliminates the problems of incidence loss and performs with the increased range associated with a ribbed diffuser but with much higher efficiency. The ribbed vanes accelerate and align boundary flow, thus preventing high friction losses and reverse flow.

With reference to FIG. 2, solidity is roughly defined as the ratio of chord 26 to pitch 27 of a vane. High solidity is defined as a ratio greater than 1, low solidity as less than 1.

If low solidity vanes 14 are utilized as said vane islands or wedged vanes 13 of FIG. 1, the range of the diffuser is further improved at the expense of some efficiency with respect to an array of high solidity full vanes. This arrangement is shown in FIG. 2. As illustrated in FIG. 2, the ribbed vanes 40 are in alignement with the log spiral 28 of the core flow at the predetermined design point. Thus, once the flow has passed the ribbed vanes, the boundary and core flows proceed along the log spiral path 28. The full vanes are inclined with respect to the log spiral flow to give the benefit of a vaned diffuser, i.e., flow straightening towards the radial direction 25. An inclination of between 10° and 20° is considered adequate.

Both range and efficiency are enhanced, with respect to the device depicted in FIGS. 1 and 2, if the portion of the shroud-side wall containing the ribbed portion of the diffuser is made movable along the rotational axis of the impeller. The purpose of the movable wall is to increase the flow velocity and direction at part load to match the predetermined vane angle. This is shown in FIG. 3. Because this embodiment has a movable wall which provides a corrected flow pattern, high solidity vanes may be employed for maximum efficiency. Movable wall and slotted wall designs are well-known in the art and are shown, for example, in U.S. Pat. No. 4,070,132 issued Jan. 24, 1978, to Lynch; U.S. Pat. No. 3,365,120 issued Jan. 23, 1968, to Jassniker; and in U.S. Pat. No. 4,403,914 issued Sept. 13, 1983, to Rogo, et al. It will be understood that further improvements at monetary expense may be obtained by providing a pinched section 16, a taper or curvature 17 in the shroud-side wall, a taper or curvature in the rib edges 18 and taper or curvature in the rib leading edges 19.

The preferred embodiment of the invention from a performance standpoint is portrayed in the depiction of FIG. 4, wherein maximum range and efficiency are obtained. Ribbed vanes 20 are carried by a movable portion of the shroud-side wall 21 of the diffuser. Slots in the wall admit the passage of the vanes (either low but preferably high solidity full vanes that are vane islands or wedge vanes) into a chamber 23. A resilient bias means such as a spring 35 is provided to urge the full vanes towards the slotted wall. Thus, the movement of the wall 21 narrows the diffuser width and the width of the full vanes 22 while also adjusting the distance between the ribbed vanes 20 and opposing wall 24 of the diffuser.

While the present invention has been described in connection with certain equipment, it is to be understood that this description is made only by way of example. For example, such a device could be easily adapted to a conical diffuser following a mixed flow impeller. Thus, the aforestated description should be interpreted as an example and not as a limitation to the scope of the invention as set forth in the accompanying claims.

What is claimed is:

1. In a diffuser characterized as containing a log spiral core flow of compressible fluid, the diffuser having a central axis, a first wall and second wall, the improvement comprising:

an array of ribbed vanes substantially aligned with the log spiral core flow, followed by an array of full vanes inclined toward the radial direction from said log spiral flow;

the first wall of the diffuser including a fixed part and a movable part;

the movable part having formed therein the array of ribbed vanes; and the movable part adapted to slide axially towards the second wall.

2. The diffuser of claim 1, wherein:

the full vanes are high solidity vanes.

3. The diffuser of claim 2, wherein:

the ribbed vanes are low solidity vanes.

4. The diffuse of claim 3, wherein:

the movable part includes a pinched portion.

5. The diffuser of claim 1, wherein:

the ribbed vanes are low solidity vanes.

6. In a diffuser having a central axis, a first wall and a second. wall, the improvement comprising ribbed vanes followed by full vanes;

the ribbed vanes substantially aligned with a flow of core fluid in the form of a log spiral;

the first and second walls axially positionable with respect to one another; and the ribbed vanes attached to the first wall.

7. The diffuser of claim 6, wherein:

the first wall has formed therein an array of slots, each slot adapted to receive one of the full vanes.

8. The diffuser of claim 7, wherein:

the array of slots comprises an opening to a chamber, the chamber adapted to admit the full vanes as the first and second walls are brought axially into proximity.

9. The diffuser of claim 8, wherein:

the full vanes are high solidity vanes.

10. The diffuser of claim 9, wherein:

the ribbed vanes are low solidity vanes.

11. The diffuser of claim 8, wherein:

the full vanes are wedge vanes.

12. In a diffuser having a central axis, a first wall and a second wall, the improvement comprising:

an array of ribbed vanes followed by an array of full high solidity vanes;

the ribbed vanes forming a log spiral; and the first wall of the diffuser including a fixed part and a movable part, the movable part slidably positionable with respect to the second wall, the movabl part located radially inward of the fixed part.

13. The diffuser of claim 12, wherein:

the movable part bears the ribbed vanes and a pinched portion.

14. The diffuser of claim 13, wherein:

the ribbed vanes are low solidity vanes.

15. The diffuser of claim 12, wherein:

the full vanes are wedge vanes.

16. In a diffuser having a central axis, the improvement comprising:

a first wall having vane shaped slots formed therein, and having ribbed vanes forming a log spiral and located radially inwardly of the slots;

a second wall having low solidity full vanes affixed to it;

the walls axially positionable with respect to one another, the full vanes entering the slots of the first wall; and the slots opening into a chamber adapted to receive the full vanes.

17. In a diffuser having a central axis, the improvement comprising:

first and second walls;

the first wall having a fixed portion and a movable portion, the movable portion having ribbed vanes forming a log spiral and attached thereto, the movable portion axially positionable with respect to the second wall; and the first and second walls having a plurality of full vanes spanning therebetween, the full vanes located radially outwardly from the ribbed vanes.

* * * * *